US007357376B2

(12) United States Patent
Assmann

(10) Patent No.: US 7,357,376 B2
(45) Date of Patent: Apr. 15, 2008

(54) DEVICE FOR LIFTING AND STABILIZING LOADS

(75) Inventor: Roland Heinz Assmann, Büdingen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/663,051

(22) PCT Filed: Aug. 25, 2005

(86) PCT No.: PCT/EP2005/054192

§ 371 (c)(1),
(2), (4) Date: Mar. 16, 2007

(87) PCT Pub. No.: WO2006/032594

PCT Pub. Date: Apr. 30, 2006

(65) Prior Publication Data

US 2007/0252120 A1 Nov. 1, 2007

(30) Foreign Application Priority Data

Sep. 20, 2004 (DE) ..... 10 2004 045 516

(51) Int. Cl.
*B66D 1/36* (2006.01)

(52) U.S. Cl. ..... 254/337

(58) Field of Classification Search ..... 254/335, 254/336, 337, 338; 212/85, 98, 348
See application file for complete search history.

(56) References Cited

U.S. PATENT DOCUMENTS 2,063,914 A * 12/1936 Fitch ..... 212/331
4,251,176 A * 2/1981 Sizer et al. ..... 414/22.71
4,273,242 A 6/1981 Schaper
4,362,292 A * 12/1982 Rowan et al. ..... 254/336
6,234,453 B1 * 5/2001 Block ..... 254/285
6,840,540 B2 * 1/2005 Fugel ..... 280/763.1

FOREIGN PATENT DOCUMENTS

DE 36 36 459 A1 4/1988

* cited by examiner

*Primary Examiner*—Emmanuel M Marcelo

(57) ABSTRACT

It is described a device for lifting and stabilizing loads, comprising a frame and a height-adjustable crossmember, which is located below said frame, bears the load, and is stabilized by two intersecting telescopic struts that are hinged on the crossmember so that they can pivot, said struts being in turn secured against modifications in length by means of two stays. Each stay, which is deflected by a deflection pulley provided on the frame or crossmember in the vicinity of the hinged ends of the telescopic struts, is guided in a parallel manner to or in an essentially coaxial manner with the pivoting axis of the telescopic strut to an additional (third) deflection pulley and is then conducted to the other respective telescopic strut.

10 Claims, 3 Drawing Sheets

DEVICE FOR LIFTING AND STABILIZING LOADS

CROSS REFERENCE TO RELATED APPLICATIONS

This application is the U.S. National Stage of International Application No. PCT/EP2005/054192, filed Aug. 25, 2005 and claims the benefit thereof. The International Application claims the benefits of German application No. 10 2004 045 516.3 DE filed Sep. 20, 2004, both of the applications are incorporated by reference herein in their entirety.

FIELD OF INVENTION

The invention relates to a device for lifting and stabilizing loads, especially suspension units for motor vehicles or motor vehicle parts.

BACKGROUND OF INVENTION

Such devices are primarily used in automobile production to transport motor vehicle parts or the motor vehicle to be produced in its respective stage of production between the individual assembly points. To this end a frame is usually able to be moved horizontally on a rail, the height of a crossmember can be adjusted via the stay hinged onto it using lifting gear arranged on the frame, with the conducting of the stays being selected so that sideways swinging movements are damped.

The load, especially if it is a motor vehicle provided for assembly, should be suspended as stably as possible; this is because many assembly processes are fully automated, which demands precise positioning of the carrying apparatus, which in turn demands the most stable possible suspension of the load on the crossmember. Since simple cable drives with vertical carrying cables are not suitable to both secure the load and prevent it swinging in all directions, articulated arms or struts are used in addition to the cable stays, hinged on one side on the frame and on the other side on the crossmember and which stabilize the load without preventing the raising and lowering movements.

The numerous known solutions are complex, heavy and expensive. German Patent Application DE 36 36 459 A1 thus describes a generic device for guiding a load which similarly consists of a movable frame to which a crossmember with height adjustment is linked. To avoid swinging movements of the load in and against the direction of movement of the frame, two intersecting telescopic struts of adjustable length are provided between frame and crossmember, said struts having articulated joints in their end regions to attach them to the crossmember on one side and the frame on the other, and which serve to accept the forces arising in the direction of movement of the carrier device. In this solution the load is lifted using the lifting stays, which are hinged in the corner areas of the crossmember and are routed via deflection pulleys in the corner areas of the frame to central lifting gear arranged on the frame. For synchronization of the extension and retraction movement of the telescopic struts, these are stabilized and synchronized by a network of cable stays, with deflection pulleys being provided at the free ends of the extendable telescopic parts of the telescopic arms via which the stay connected to the fixed part of the telescopic struts, after deflection at the rear end of the extendable telescopic struts, is routed to the other telescopic strut in each case and is attached there. Since the stays are routed in a symmetrical mirror image, each stay is stressed for tension in a direction opposite to that of the other stay, whereby a largely swing-free movement of the load can be achieved. This is based on the fact that, with an exactly vertical lowering process, the distance between the two stay attachment points of each of the two synchronous stays remains independent of the lift position. On the other hand a movement of the crossmember from the central position in or against the direction of travel means that the distance between the stay hinge points wants to change, and that one of the distances wants to increase and another wants to decrease. However, since the stay of which the two fixing points wish to move away from each other acts against the extension, a stabilizing effect is introduced. The other stay would by contrast be compressed and cannot offer any resistance to the deflection. If the direction of the crossmember deflection changes, the effect reverses, so that the two synchronized stays alternate in stabilizing the crossmember.

In the prior art outlined above, the stay tensioning effect described produces a disadvantage which prevents the known solution from functioning correctly. The guidance of the synchronized stays over the deflection pulleys in the area of the hinging of the telescopic struts on the crossmember with deflection pulley axes arranged at right angles to the direction of travel of the crossmember means that the angle of grip on the stay deflection pulleys increases or decreases depending on the lift position of the crossmember or the angular position of the telescopic struts. Since the distances between the stay hinge points do not change the synchronized stays would have to be extended or shortened for an exact vertical lifting movement of the crossmember. This could however only be compensated for by an elasticity of the synchronized stays, e.g. by springs at the stay attachment points. Such elasticity of the stay tensioning runs contrary to the requirement for a stiff, swing-free suspension guidance however.

SUMMARY OF INVENTION

An object of the present invention, is to improve a device for lifting and stabilizing loads of the generic type so that, with a simple and lightweight construction, a stable and swing-free transportation of loads is also possible in and against the direction of travel.

The device for lifting and stabilizing loads, especially suspension units for motor vehicles or motor vehicle parts, consists e.g. of a frame and also a crossmember arranged below it to accommodate the load, which is height-adjustable by means of stays attached to the crossmember and which can be stabilized by means of two intersecting telescopic struts running essentially in an imaginary plane in parallel to the direction of travel of the frame, that are hinged on one side on the frame and on the other on the crossmember, which in their turn are secured against any undesired modifications in length resulting from forces operating in the longitudinal direction of the crossmember, to which end a stay permanently connected to one of the telescopic struts is conducted via a first deflection pulley to a second deflection pulley in the vicinity of the hinged end of the telescopic strut and from there, via the second deflection pulley supported on the respective other telescopic strut, to an attachment point on the respective other telescopic strut.

To achieve the object it is proposed in accordance with the invention that at least the second deflection pulleys provided in the area of the hinged ends of the telescopic struts on the frame or on the crossmember for one of the stays in each case rotate in parallel to the imaginary plane which runs through the pivot axis of the telescopic strut, and that each stay deflected by the second deflection pulley is routed in parallel or essentially coaxially to the pivot axis of the telescopic strut to a further (third) deflection pulley, via which the stay is rerouted to the other telescopic strut in each case. One idea behind the present invention thus consists of preventing the stay length change produced in the prior art on deflection of the stay around the deflecting pulley provided in the connecting area of the telescopic struts so that the stay is routed during the deflection in the most coaxial possible manner to the pivot axis of the telescopic struts. This can however not be completely implemented since in each deflection area two stays are routed alternately to the two telescopic struts but care must be taken that these stays are routed lying as closely as possible to each other in parallel to the pivot axis of the telescopic struts. Accordingly the second deflection pulleys forming a pair in each case of a telescopic strut are supported as close as possible to the intended plane, i.e. so that the stays in the area of the pivot axis of the telescopic struts are routed as closely as possible to each other.

The further (third) deflection pulley provided conducts the stay back, generally after a double 90° deflection in one and the same plane, in order to route the stay directly to the other respective telescopic strut and from there to the attachment point of the other telescopic strut.

The present invention has in practice turned through 90° the pivot axes of the deflection pulleys as provided in the prior art, so that the axes in the invention run at right angles to the pivot axes of the telescopic struts. The double 90° deflections on the link-side end of the telescopic struts has the effect of routing the stay section between the 90° deflections essentially through the center point of the pivot movement, i.e. the support of the telescopic struts. This causes the stay to twist when passing through the support of the telescopic struts during a pivoting or lifting movement of the telescopic struts, but not to change its length. This means that the synchronized stay does not require the indispensable elasticity of the known solution, so that a very rigid suspension stabilization is achieved.

There is provision in an embodiment of the invention for the first deflection pulleys in each case to be mounted within the outer telescopic parts and for the second deflection pulleys in each case at the outer end of each movable telescopic part. This implements a reversal of the solution provided in the prior art which is more favorable for stay guidance, where the first deflection pulley is attached to the inner end of the extendable telescopic part and where the stay is connected to the fixed part of the telescopic strut.

To implement a routing of the stay between the second and further (third) deflection pulley in each case as closely as possible to the pivot axis of the telescopic strut on a frame or on the crossmember, there is provision according to an especially important feature of the invention to embody the pivot supports of the telescopic struts as hollow bearings and to route the stays through the tubular or sleeve-type pivot axis formed in this way.

It has proved especially favorable for provision to be made in an embodiment of the invention for the one end of each stay to be attached to the retracted end of a movable telescopic part, from where it is routed via a first deflection pulley supported on the outer telescopic part in the opposite direction to the second deflection pulley provided on the connecting end of the outer telescopic part on the frame or on the crossmember, via which the stay is essentially routed coaxially to the pivot axis of the telescopic strut to the third deflection pulley arranged on a parallel axis outside the telescopic struts, which deflects the stay to the other telescopic strut in each case, where the stay is routed back in a mirror image to the first telescopic strut and is attached to the retracted end of the moveable other telescopic part.

The present invention differs markedly from the stay routing proposed in the German Patent Application DE 36 36 459 A1 and avoids the disadvantages arising there in favor of an especially rigid and stable crossmember guidance. The fact that the stays are routed in the invention in the deflection area in the pivot point of the telescopic struts and through the support bolts of the telescopic struts means that, when the crossmember is raised or lowered with the load, the stay length remains practically constant, so that the stability of the crossmember in and against the direction of travel can be achieved with simple technical means.

BRIEF DESCRIPTION OF THE DRAWINGS

An exemplary embodiment of the invention is shown in the drawing and is described below. The figures show.

DETAILED DESCRIPTION OF INVENTION

Figure 1:
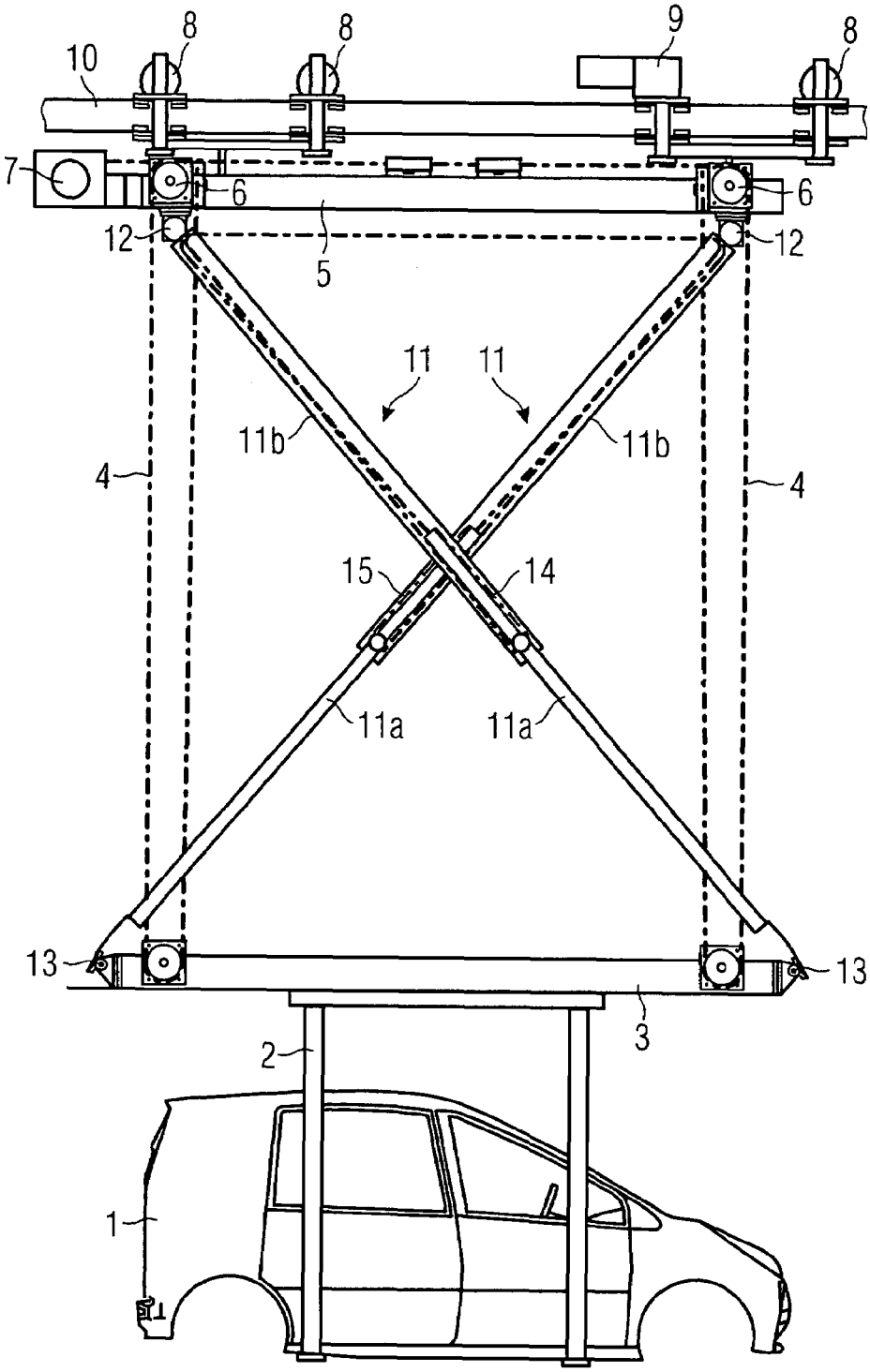
FIG. 1 an inventive device for lifting and stabilizing loads in the form of a suspension unit for motor vehicles, FIG. 2 the routing of the stays as proposed in the invention, FIGS. 3, 4 the routing in each case of one of the two stays depicted in FIG. 2 and FIG. 5 the inventive arrangement of the second and third deflection pulleys on the frame-side end of the telescopic struts.

FIG. 1 shows a simplified schematic diagram of the inventive device for lifting and stabilizing loads. A motor vehicle body 1 is suspended from the crossmember 3 by a suspension unit, which for its part is suspended to allow it to be raised or lowered via the lifting stays 4 on the frame 5, with the lifting stays 4 being routed via deflection pulleys 6 to central lifting gear 7 through which the raising and lowering of the crossmember can be initiated. The frame 5 is driven on the wheels 8 and by a motor drive unit 9 along the horizontal rail 10 in order to transport the motor vehicle body 1 from one assembly point to the next.

When the lifting stay 4 is wound back onto the drums of the lifting gear 7 the telescopic struts 11 provided for the stabilisation of the crossmember in the direction of travel, which are arranged to intersect between the frame 5 and the crossmember 3, change their length and make it possible to move the crossmember 3 closer to the frame 5 and thereby to lift the vehicle body to the desired height. The construction is selected so that the crossmember 3 is able to be raised high enough for it to lie on or in the frame 5, in which case the extendable parts 11*a* of the telescopic struts 11 retract into their fixed parts 11*b*.

In this case the angle between the intersecting telescopic struts changes until the telescopic struts lie in parallel to the frame or the crossmember. At the same time the telescopic struts pivot around their linkage points 12 and 13 on the frame and on the crossmember.

To achieve an optimum stability and above all a synchronization of the movement sequences of the telescopic struts and thereby of the crossmember, the two stays 14 and 15 are provided, said stays being deflected and routed so that one of the two stays routed in a mirrored arrangement can accept the forces arising in one of the directions of movement (direction of crossmember travel).

The routing of the stay in the telescopic struts is shown schematically in FIG. 2 and is explained below. The two similarly embodied telescopic struts 11, each consisting of a fixed part 11*b* and a movable (telescopable) part 11*a*, can be seen in the diagram. The movable parts 11*a* are guided telescopically via roller guides (not shown) in the fixed parts 11*b*. The one stay 14 is attached, as can be seen in upper half of FIG. 2, to the retracted (inner) end of the movable part 11*a* of the telescopic strut 11 at point 21*a* and is routed from there in parallel to the longitudinal axis of the telescopic strut 11 to a deflection pulley 16 which has fixed support on the immovable part 11*b* of the telescopic strut 11. After a deflection of the stay 14 by 180° this is routed to the second deflection pulley 17 which is arranged at the end of the telescopic strut 11, at which this strut is linked in a pivotable manner to the frame 5 at point 12 (FIG. 1). Both the first deflection pulley 16 and also the second deflection pulley 17 are arranged in parallel to an imaginary plane running through the pivot axis 18 of the telescopic strut 11. Thus the pivot axes of the deflection pulleys 17 are aligned at right angles to the pivot axis 18 of the telescopic struts 1. The stay 14 is deflected and routed via the deflection pulleys 17 so that it runs as closely as possible or exactly coaxially to the pivot axis 18 of the telescopic strut 11.

For this purpose it can be seen that the pivot bearing 19 of the telescopic strut 11 is embodied as a hollow pin or bolt so that the stay 14 and the returned second stay 15—as described below—can be routed to pass through the axis.

Outside the telescopic strut 11 a third deflection pulley 20 is arranged on a parallel axis to the deflection pulley 17 which is used for further deflection and routing back of the stay 14 to the end of the second (in the drawing lower) support strut 11, where, in a mirror image, the stay 14 is first guided around the third deflection pulley arranged there coaxially to the pivot axis 18 to the second deflection pulley 17 and from there back to the end of the extendable part 11*a* of the other support strut in each case 11, where it is attached at point 21*b*. The stay 15 is routed in a mirror arrangement in the opposite direction, and is routed from the end of the movable part 11*a* of the support strut 11, where it is attached at 21*c* in the reverse direction through to the end of the other support strut 11, where, in the same manner (as stay 14) it is attached at 21*d*.

Figure 2:
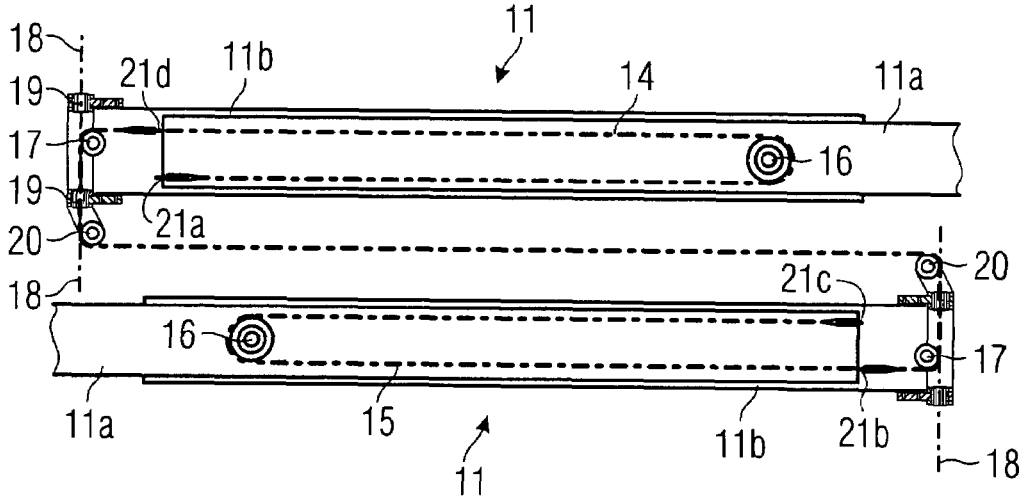
Figure 3:
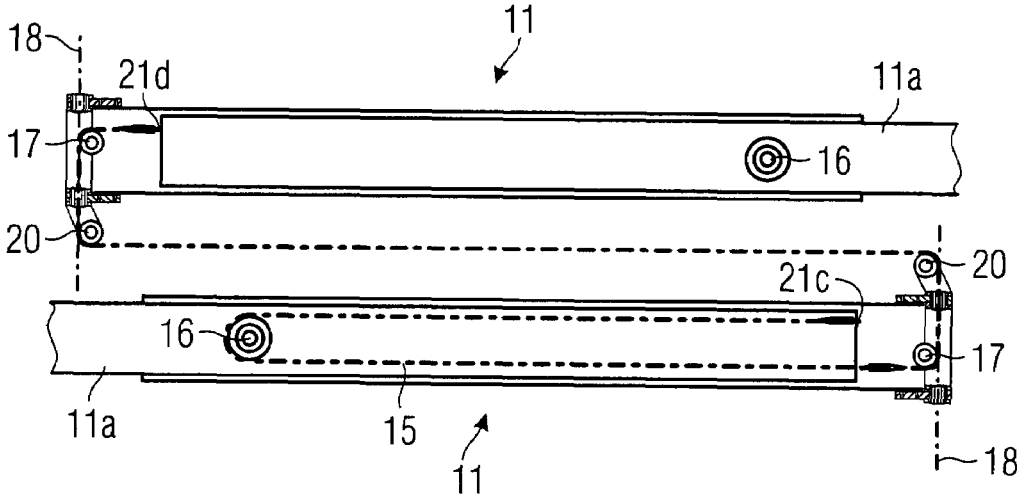
Figure 4:
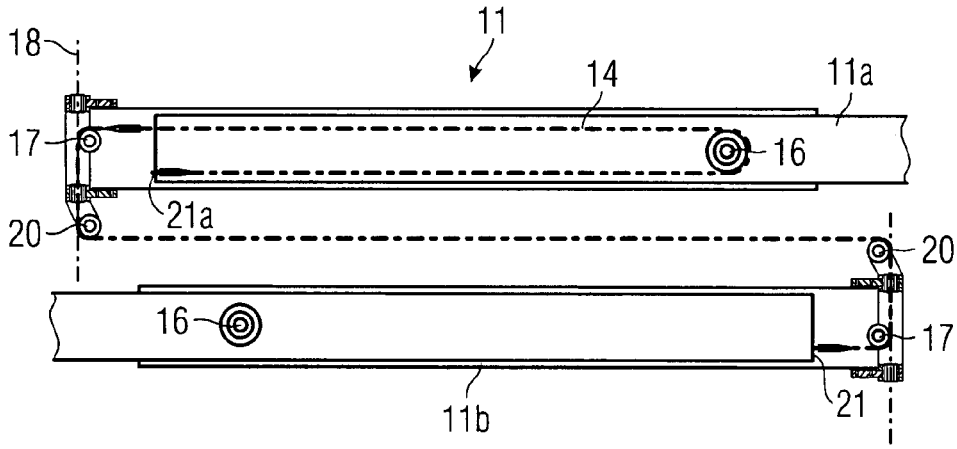

The stay routing of the two stays is shown separately in FIGS. 3 and 4, since the routing of the stays lying behind each other cannot be clearly seen from the diagram shown in FIG. 2. FIG. 3 shows the routing of the stay 15 from the end of the movable part 11*a* of the telescopic strut 11, where the stay is attached at 21*c*, via the first deflection pulley 16 to the second deflection pulley, from there coaxially to the pivot axis 18 of the telescopic strut 11 to the third deflection pulley, from there back to the third deflection pulley 20 of the other telescopic strut 11, once again coaxially to the pivot axis 18 of the telescopic strut 11 and via the second deflection pulley 17 to the end of the extendable part 11*a* of the other telescopic strut 11, where the stay is attached at 21*d*.

The stay 14 is routed and connected in the same manner, but in the reverse direction, in the diagram shown in FIG. 4, the deflection pulleys and attachment points are each labeled as shown in FIG. 2.

Figure 5:
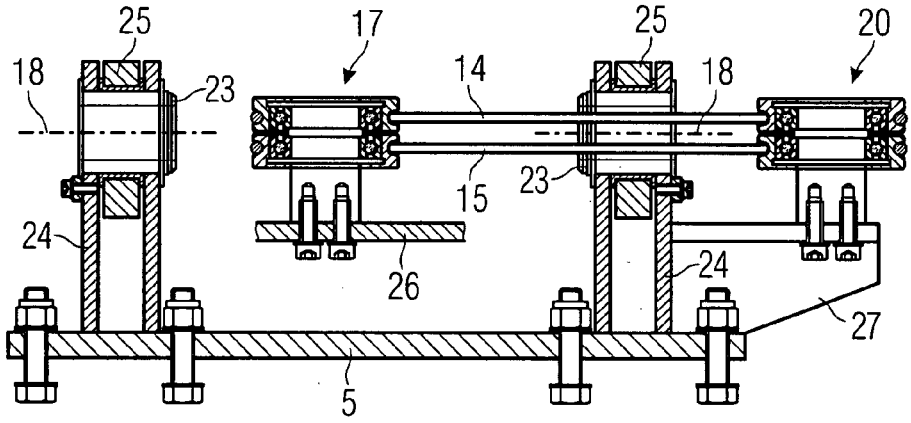

FIG. 5 shows an enlarged diagram of the area of the stay deflection at a frame-side end of one of the telescopic struts 11. The diagram shows the support crossmember attached to the frame 5 with the two support struts 24, which are accommodated by the lugs 25 attached to the telescopic strut. Pivot bearings 23 are pushed through the coaxial holes in the lugs 25 and the support struts 24 and fixed. The pairs of second deflection pulleys 17 and on a console 27 likewise pairs of third deflection pulleys 20 around which the stays 14 and 15 are deflected are supported on a crossmember 26 of the fixed part 11*b* of the telescopic strut 11. The console is attached to the frame 5 and does not pivot along with its telescopic strut. As can further be seen in FIG. 5, the stays 14 and 15 are routed through the pivot bearing 23, so that they essentially extend in parallel to the pivot axis 18 of the telescopic strut 11. When the telescopic strut 11 pivots around the pivot axis 18 together with the deflection pulleys 17 the stays 14 and 15 twist to a slight extent between the pivoted deflection pulleys 17 and the pair of deflection pulleys 20 fixed to the frame, without the stays 14 and 15 being lengthened.

Variants in the stay routing are conceivable within the framework of the invention, provided the stays 14 and 15 are essentially routed through the pivot axes of the telescopic struts.

The invention claimed is:

1. A device for lifting and stabilizing loads, comprising:

a frame;

a crossmember arranged below the frame to accommodate the load;

a plurality of lifting stays attached to the crossmember to adjust the height of the crossmember;

at least two intersecting telescopic struts running essentially in an imaginary vertical plane in parallel to a proposed direction of travel of the frame, wherein the telescopic struts are attached by hinged connections to the frame on one side of the telescopic strut and to the crossmember on a other side of the telescopic strut, wherein the telescopic struts are secured by stays running symmetrically, against undesired length changes resulting from forces acting in a longitudinal direction of the crossmember;

a first deflection pulley connected to the telescopic strut; and a second deflection pulley for the stay of the telescopic strut, wherein the second deflection pulley is for rotation in parallel to an imagined plane running through the pivot axis of the telescopic strut, wherein the stay is permanently connected to one of the two telescopic struts and routed via the first deflection pulley to the second deflection pulley provided in the area of the hinged connection of the telescopic strut and from there via the second deflection pulley supported on the other telescopic strut to an attachment point on the other telescopic strut, and the stay deflected by one of these second deflection pulleys is routed in parallel or essentially coaxially to the pivot axis of the telescopic strut to a further deflection pulley, via which the stay is routed to the other telescopic strut in each case.

2. The device as claimed in claim 1, wherein the first deflection pulley is supported within an outer telescopic part and the second deflection pulley at an outer end of one of the extendable telescopic parts in each case.

3. The device as claimed in claim 1, wherein the telescopic struts are supported on the frame or on the crossmember based upon pivot supports, wherein the pivot supports are embodied hollow to allow the stays to pass through their center.

4. The device as claimed in claim 1, wherein an end of the stay is attached to a retracted end of a movable telescopic part and routed via the first deflection pulley supported in an outer telescopic part in the opposite direction to the second deflection pulley provided on the connecting areas of the outer telescopic part provided on the frame or on the crossmember.

5. The device as claimed in claim 4, wherein the stay is routed essentially coaxially to the pivot axis of the telescopic strut to the third deflection pulley arranged on a parallel axis outside the telescopic strut.

6. The device as claimed in claim 5, wherein the third deflection pulley diverts the stay from one telescopic strut to the other telescopic strut.

7. The device as claimed in claim 6, wherein the stay is routed back in a mirrored arrangement to the first telescopic strut and is attached to the retracted end of the movable other telescopic section.

8. The device as claimed in claim 1, wherein the device is a suspension unit for a motor vehicle.

9. The device as claimed in claim 1, wherein the device is a suspension unit for a motor vehicle part.

10. The device as claimed in claim 1, wherein the crossmember is securely stabilized based upon the two intersecting telescopic struts.

* * * * *